US007065951B2

(12) United States Patent
Baur

(10) Patent No.: US 7,065,951 B2
(45) Date of Patent: Jun. 27, 2006

(54) YARN WITHDRAWAL NOZZLE FOR AN OPEN-END ROTOR SPINNING ARRANGEMENT AND METHOD OF MAKING SAME

(75) Inventor: Guenter Baur, Suessen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 11/077,141

(22) Filed: Mar. 11, 2005

(65) Prior Publication Data

US 2005/0229580 A1 Oct. 20, 2005

(30) Foreign Application Priority Data

Mar. 15, 2004 (DE) ..... 10 2004 013 828

(51) Int. Cl.
*D01H 4/10* (2006.01)

(52) U.S. Cl. ..... 57/417

(58) Field of Classification Search ..... 57/404–417
See application file for complete search history.

(56) References Cited

U.S. PATENT DOCUMENTS 4,516,397 A 5/1985 Raasch et al.
5,423,177 A 6/1995 Raasch
6,035,625 A 3/2000 Schloemer et al.
6,886,322 B1 * 5/2005 Weide et al. ..... 57/404

FOREIGN PATENT DOCUMENTS

| | | |
|---|---|---|
| DE | 32 20 402 A1 | 12/1983 |
| DE | 42 24 632 A1 | 1/1994 |
| DE | 197 38 382 | 3/1999 |
| DE | 102 55 723 A1 | 10/2003 |
| DE | 10329612 | 1/2005 |
| WO | WO 03/097911 A1 | 11/2003 |

* cited by examiner

*Primary Examiner*—Shaun R Hurley
(74) *Attorney, Agent, or Firm*—Crowell & Moring LLP

(57) ABSTRACT

A yarn withdrawal nozzle for an open-end rotor spinning arrangement is provided which includes a spiral-shaped surface in the yarn deflecting area which extends essentially over the entire yarn deflecting area and designed as a continuous spiral without interruptions. In addition thereto, the nozzle throat of the yarn withdrawal nozzle includes a further surface with structure downstream of the spiral-shaped surface, including rounded notches or curved humps. Both the spiral-shaped surface and the downstream structure are so designed that they are capable of transferring forces to the yarn without damaging same. The yarn withdrawal nozzle is moulded with a mould separation provided in an area downstream of the nozzle throat to facilitate assembly.

21 Claims, 3 Drawing Sheets

YARN WITHDRAWAL NOZZLE FOR AN OPEN-END ROTOR SPINNING ARRANGEMENT AND METHOD OF MAKING SAME

BACKGROUND AND SUMMARY OF THE INVENTION

This application claims the priority of German Application No. 10 2004 013 828.1 filed on Mar. 15, 2004, the disclosure of which is expressly incorporated by reference herein.

The present invention relates to a yarn withdrawal nozzle for an open-end rotor spinning arrangement comprising a yarn deflecting area and a nozzle throat, in which means for increasing the spinning stability are provided, and in which a spiral-shaped structure is provided in the yarn deflecting area.

Spinning stability often presents a problem in the case of open-end rotor spinning arrangements, as the introduced true yarn twist is not evenly present in the formed yarn end. The introduction of yarn twist takes place mainly between the yarn withdrawal nozzle and the delivery device of the finished yarn. It is often poor in the area between the rotor groove and the yarn withdrawal nozzle. Insufficient twist in this area leads to a low spinning stability, as the binding-in of new fibres in the yarn end no longer functions properly when the reduction in the level of twist falls below a certain value, which in turn results in end breaks. The problem is aggravated in that the form of the yarn withdrawal nozzle has not only a deciding influence on the spinning stability, but also on the yarn quality.

Countless known variations in the design of yarn withdrawal nozzles for open-end rotor spinning arrangements have been made in the past. The optimal yarn withdrawal nozzle, which combines the partly contradictory aims of producing a high yarn quality while simultaneously achieving a good spinning stability, has not yet been found.

A plurality of such known yarn withdrawal nozzles with their advantages and disadvantages are described in the German published patent application 197 38 382 (corresponding U.S. Pat. No. 6,035,625). It is disclosed that "spiral nozzles" produce better yarn values than "notch nozzles", but achieve a lower spinning stability. As an improvement, a yarn withdrawal nozzle is described which comprises a spiral-shaped surface in the outer area of the funnel-shaped tapering yarn deflecting area, and additional notches in the inner area of the funnel-shaped yarn deflecting area. This embodiment has the disadvantage in that the notches in the yarn deflecting area may damage the yarn very slightly, as the yarn, while it is being deflected at an angle of 90°, is pressed very hard onto the surface of the yarn withdrawal nozzle. In addition, the spiral-shaped structure does not achieve its optimal effect, as it is located only in the outer area of the yarn deflecting area.

A yarn withdrawal nozzle comprising interrupted ribbed structures as well as notches beginning in the yarn deflecting area is known in international patent application WO 03/097911. As a result of the way the yarn is pressed hard onto the nozzle wall, the interruptions of the ribbed structures have almost the same effect as notches. A further disadvantage is that the interruptions are located very far away from the center line of the yarn withdrawal nozzle. The greater the distance of the interruption from the center line, the more aggressive the effect on the yarn, and the quicker yarn damage occurs. At the same rotational speed of the yarn, the pressing onto the nozzle wall due to the centrifugal forces is proportional to the distance from the center line. In addition, the speed of the surface of the nozzle wall, which surface skims past the yarn, is also proportional to the distance from the center line.

German published patent application 42 24 632 (corresponding U.S. Pat. No. 5,423,177) describes a "spiral nozzle", in which the spiral-shaped structure in the yarn deflecting area is formed by linear surfaces. The aim here is to keep the contact pressure of the deflected yarn to a minimum. In the transition areas of the linear surfaces from one spiral corridor to the next, edges are provided which transfer the forces to the yarn. It is disadvantageous that the edges, when new, are relatively sharped-edged and can thus easily damage the yarn. Furthermore, these sharp edges wear out very quickly, so that the forces transferable to the yarn are of different strengths. If, as provided for sensitive yarns, the edges are rounded from the beginning, then the contour of the funnel-shaped yarn deflecting area is almost comparable to a smooth nozzle. The advantages of a "spiral nozzle" are thus practically no longer present.

The non-generic German published patent application 102 55 723 describes a yarn withdrawal nozzle comprising a coaxial circular structure of bulges and grooves in the yarn deflecting area, as well as notches positioned downstream for a high spinning stability. Here the cost-effective production by means of simple tools is of foremost importance. The advantages of the spiral in the yarn deflecting area are deliberately omitted and lesser yarn values are taken into account.

Supplementary to the structures in the yarn deflecting area of the yarn withdrawal nozzle, balloon-disturbing sleeves, also known as "vortex inserts", which are arranged downstream of the yarn withdrawal nozzle, are known from German published patent 32 20 402 (corresponding U.S. Pat. No. 4,516,397). These balloon-disturbing sleeves are applied for generating a particularly hairy yarn. These are essentially spinning components which processes the yarn very roughly, as the pulling out of the individual fibers to create the desired hairiness, the formed yarn is damaged to such an extent that the tensile strength and evenness values deteriorates.

Based on the first mentioned publication, it is an object of the present invention to create a further improved yarn withdrawal nozzle which delivers high yarn values together with a high degree of yarn stability.

This object has been achieved in the case of a yarn withdrawal nozzle of the above mentioned type according to certain preferred embodiments of the present invention in that the spiral-shaped structure extends essentially over the entire yarn deflecting area and is designed as a continuous structure without interruptions, and in that in the nozzle throat in yarn withdrawal direction there is another structure directly downstream of the spiral-shaped structure, wherein both structures in the yarn deflecting area and in the nozzle throat comprise rounded bulges and deflecting area and in the nozzle throat comprise rounded bulges and rounded recesses, so that forces are transferred to the yarn by the structures in a way which does not damage the yarn.

Due to the regular waved shape of the structure in almost the entire funnel-shaped yarn deflecting area, the yarn withdrawal nozzle of the present invention possesses the advantage in that a particularly good yarn rest and yarn support is possible even in the highly problematic yarn deflecting area. At the same time, forces arise due to the spiral-shaped structure which have an effect on the yarn and whose height can be easily influenced by the height of the wave-shaped structure. The forces work on the one hand as a thrust component against the withdrawal direction and favor the spread of the twist in the direction of the rotor groove. On the other hand they effect a rolling component around the yarn axis, which effects a rolling of the yarn at the funnel-shaped yarn deflecting area. Thanks to the rolling, long single fibers, standing out from the yarn, are laid down. This effects an improvement in the quality of the yarn, as the long hairs are particularly undesirable in further processing. Furthermore the rolling of the yarn effects a false twist generation, which in turn effects a higher yarn twist in the area between the rotor groove and the yarn withdrawal nozzle. The rolling procedure is supported by the structures in the nozzle throat, as thread tension variations are generated in the yarn. The yarn, rotating in the form of yarn balloon, comes into contact with the walls of the nozzle throat and is put into a twist around its own longitudinal axis by the structures in the nozzle throat. This brings about an increase in spinning stability while at the same time achieving good yarn values. Because the structure in the nozzle throat consists of rounded bulges and recesses, and because the relative speed of the yarn to the nozzle throat walls is low due to a correspondingly small diameter of the nozzle throat, yarn and fibre damage does not occur even at high rotor speeds.

In a further advantageous embodiment of the invention it is provided that the yarn withdrawal nozzle is designed in such a way that it is particularly simple and cost-effective to make. The spiral-shaped structure in the yarn deflecting area is formed without an undercut, so that the yarn withdrawal nozzle can easily be removed from the mould when being made by means of casting or pressing processes.

In order to achieve a long serviceable life, the yarn withdrawal nozzles are made out of a high-performance ceramic. In the case of particularly temperature-sensitive fibre materials such as polyester, it is advantageous to make the yarn withdrawal nozzle, at least in the yarn deflecting area, from steel—for example hardened steel. This ensures good heat transport. In a further embodiment of the present invention it can be advantageous to design the metal yarn withdrawal nozzle with a wear-resistant coating.

In order to increase flexibility it is advantageous to design the yarn withdrawal nozzle as a multi-part component, and to combine various structures in the nozzle throat together with a basic design of the spiral in the yarn deflecting area. Thus different materials can be easily combined according to the requirements regarding heat conductivity and wear resistance.

These and further objects, features and advantages of the present invention will become more readily apparent from the following detailed description thereof when taken in conjunction with the accompanying drawings

DETAILED DESCRIPTION OF THE DRAWINGS

Figure 1:
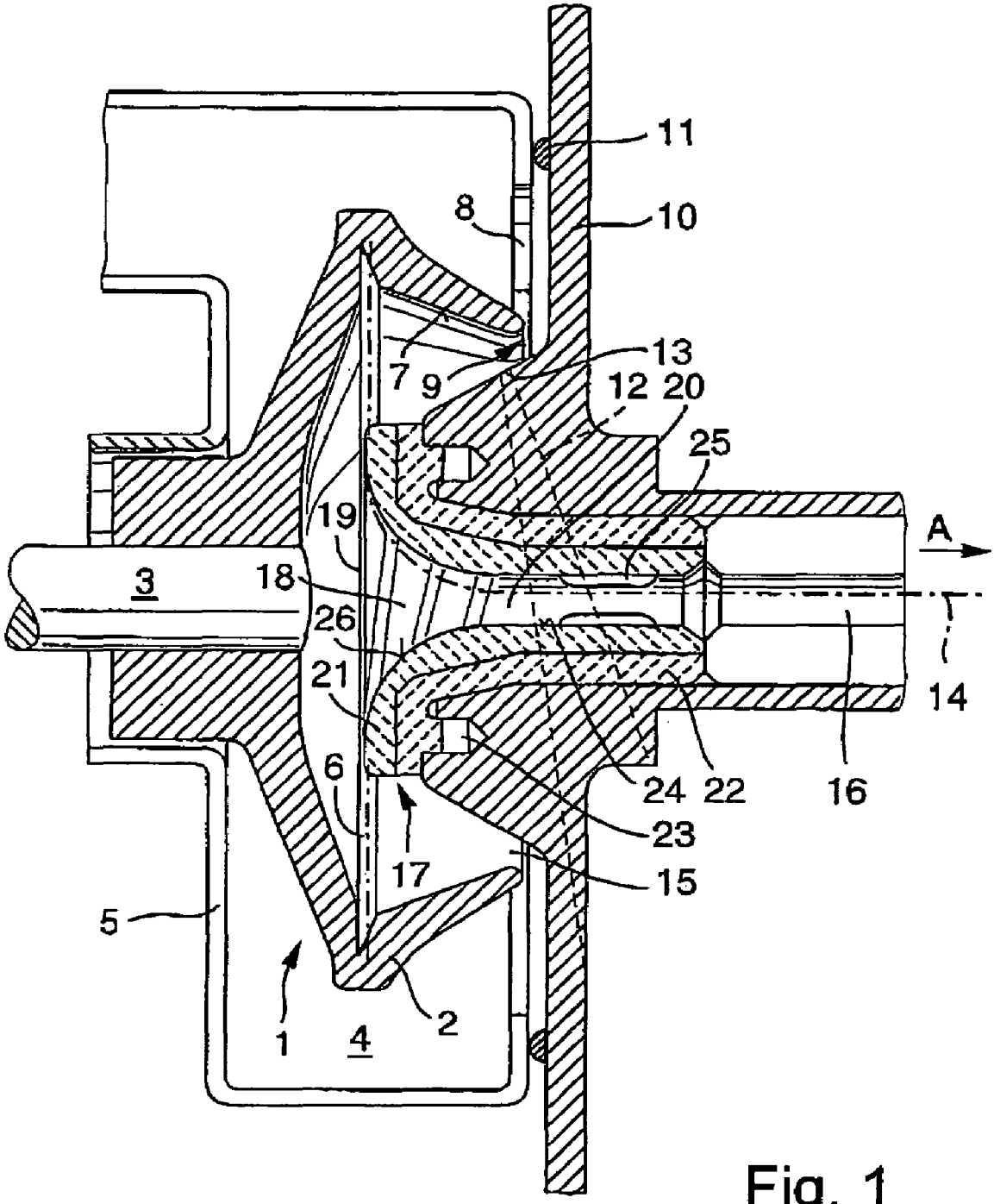
FIG. 1 is an enlarged axial sectional depiction of a part of an open-end rotor spinning arrangement in the area of the yarn withdrawal nozzle, constructed according to preferred embodiments of the present invention.

The only partly shown open-end rotor spinning arrangement in FIG. 1 comprises a spinning rotor 1, which comprises a rotor cup 2 and a shaft 3 pressed into the rotor cup 2. The shaft 3 is supported and driven in a way not shown here. The rotor cup 2 rotates during operation in a vacuum chamber 4, which is formed by a rotor housing 5, which is connected to a vacuum source in a way not shown.

The rotor cup 2 comprises a fibre sliding surface 7 which extends conically towards a fibre collecting groove 6. The hollow interior of the rotor cup 2 has its largest diameter in the fibre collecting groove 6. The spinning rotor 1 can be pulled out through a front opening 8 of the rotor housing 5 towards the operator's side of the open-end spinning arrangement. During operation, this opening 8 of the rotor housing 5, together with the open front side 9 of the rotor cup 2 is covered over by a movable covering 10. The covering 10 is disposed on the rotor housing 5 with a sealing ring 11 between the two parts.

The covering 10 comprises a fibre guiding channel 12 which lies outside of the drawing plane, and which, in a way not shown, begins with an opening roller, the mouth 13 of which is aligned against the fibre sliding surface 7. Due to the effect of the above mentioned vacuum source, single fibers are shot during operation by the opening roller through the fibre guiding channel 12 against the fibre sliding surface 7, from where they slide into the fibre collecting groove 6, form there a fibre ring and are withdrawn in the known way as yarn 14, shown as a dot-dash line, in axial direction of the shaft 3. The air sucked in via the fibre feed channel 12 can flow off via an overflow opening 15 on the open front side 9 of the spinning rotor 1.

The spun yarn 14 is first withdrawn out of the fibre collecting groove 6 at least approximately in a perpendicular plane towards the shaft 3 of the spinning rotor 1 and subsequently withdrawn by means of a delivery roller pair (not shown) via a yarn withdrawal channel 16 according to the withdrawal direction A and then guided to a winding-on bobbin (also not shown). The yarn withdrawal channel 16 is disposed at least with its initial part coaxially to the shaft 3 of the spinning rotor 1, so that the yarn 14 leaving the fibre collecting groove 6 is at first deflected at an angle of approximately 90°, whereby the yarn 14 simultaneously rotates in a crank-like manner in the above mentioned perpendicular plane.

The deflecting of the yarn 14 from the above mentioned perpendicular plane into the yarn withdrawal channel 16 is effected via a yarn withdrawal nozzle 17, which begins with an essentially funnel-shaped, curved yarn deflecting area 18 on a surface 19 lying in the perpendicular plane, and which graduates over into a nozzle throat 20. The yarn withdrawal nozzle 17 comprises a nozzle insert 21, preferably made of ceramic, which is glued into a nozzle mounting 22, whereby the nozzle mounting 22 is held by means of holding magnets 23 to the cover 10.

It should be mentioned at this point that the crank-like rotating speed of the yarn 14 is very much greater than the speed of the yarn 14 in delivery direction A. Because of the crank-like rotation of the withdrawn yarn 14 at the front surface 19, the yarn 14 rotates balloon-like downstream of the nozzle throat 20, whereby it is pressed against the walls 24 of the nozzle throat 20 due to the centrifugal forces. This state can be turned to advantage in that the walls 24 are designed in a particular way, for example having rounded bulges and/or recesses 25, with which the yarn 14 comes into contact due to its balloon-like shape.

Figure 2:
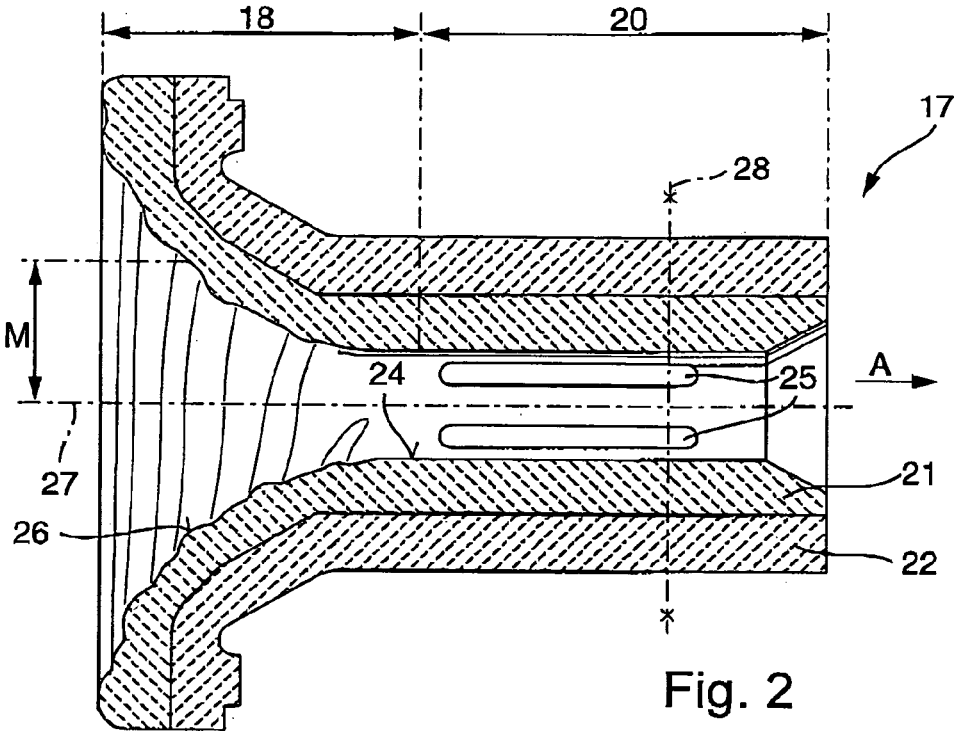
FIG. 2 is a further enlarged axial section depiction of a yarn withdrawal nozzle, in which the nozzle throat and yarn deflecting area are designed as one-piece, constructed according to preferred embodiments of the present invention.

FIG. 2 shows a further enlarged view of a yarn withdrawal nozzle 17 in axial section. In this case, a ceramic nozzle insert 21 is adhered into the nozzle mounting 22. The surface 26 of the spiral-shaped structure in the yarn deflecting area 18 is formed by a geometric curve, which is not rotationally symmetric to the center line 27. This curve has instead the characteristic that while advancing in withdrawal direction A, the distance M between the surface 26 and the center line 27 constantly and continuously decreases. As a result of this, no undercut—as seen in delivery direction A—emerges in the interior of the nozzle insert 21. This property has the geometric curve for any axial section of choice of the nozzle insert 21. It permits the ejection of the nozzle insert 21 during pressing by means of a one-piece tool located in the yarn deflecting area 18. This has the advantage in that the yarn deflecting area 18 has a smooth surface 26 without any burrs or defects. A faultless surface 26 is particularly important in the yarn deflecting area 18 as the yarn 14 is pressed very hard onto the surface 26 while being deflected at an angle of 90°.

The nozzle throat 20 is equipped in this case with longitudinal raised areas and recesses 25 which extend parallel to the middle line 27. If the structures in the nozzle throat are designed as raised areas, for example in FIG. 3 as curved humps 29, the front part of the nozzle throat 20 can even be designed without an undercut, so that the mould separation 28 of the press tools can be placed in the rear part—as seen in delivery direction A—of the nozzle throat 20. A mould separation 28 which lies as far back as possible has the advantage in that any possible faulty places on the walls 24 of the nozzle throat 20 have a reduced effect on the yarn 14, as the pressing force of the yarn balloon on the wall 24 decreases as it advances in delivery direction A.

Figure 3:
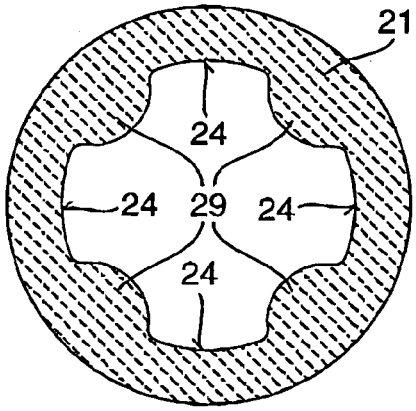
FIG. 3 is a further enlarged radial section depiction of a nozzle throat, in which the structure is formed by humps, constructed according to certain preferred embodiments of the present invention.
Figure 4:
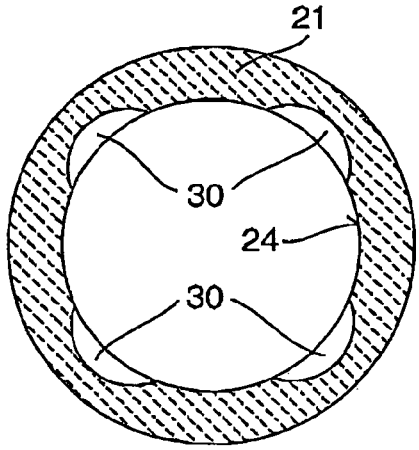
FIG. 4 is a view similar to FIG. 3, in which the structure in the nozzle throat is formed by notches, constructed according to certain preferred embodiments of the present invention.

FIGS. 3 and 4 show a radial section of the nozzle throat 20 along the line of the mould of separation 28 in FIG. 2. FIG. 3 shows a nozzle insert 21 having a structure which is designed as curved humps 29 on the wall 24. FIG. 4 shows in contrast a structure in which gentle notches 30 have been made in the wall 24.

Figure 5:
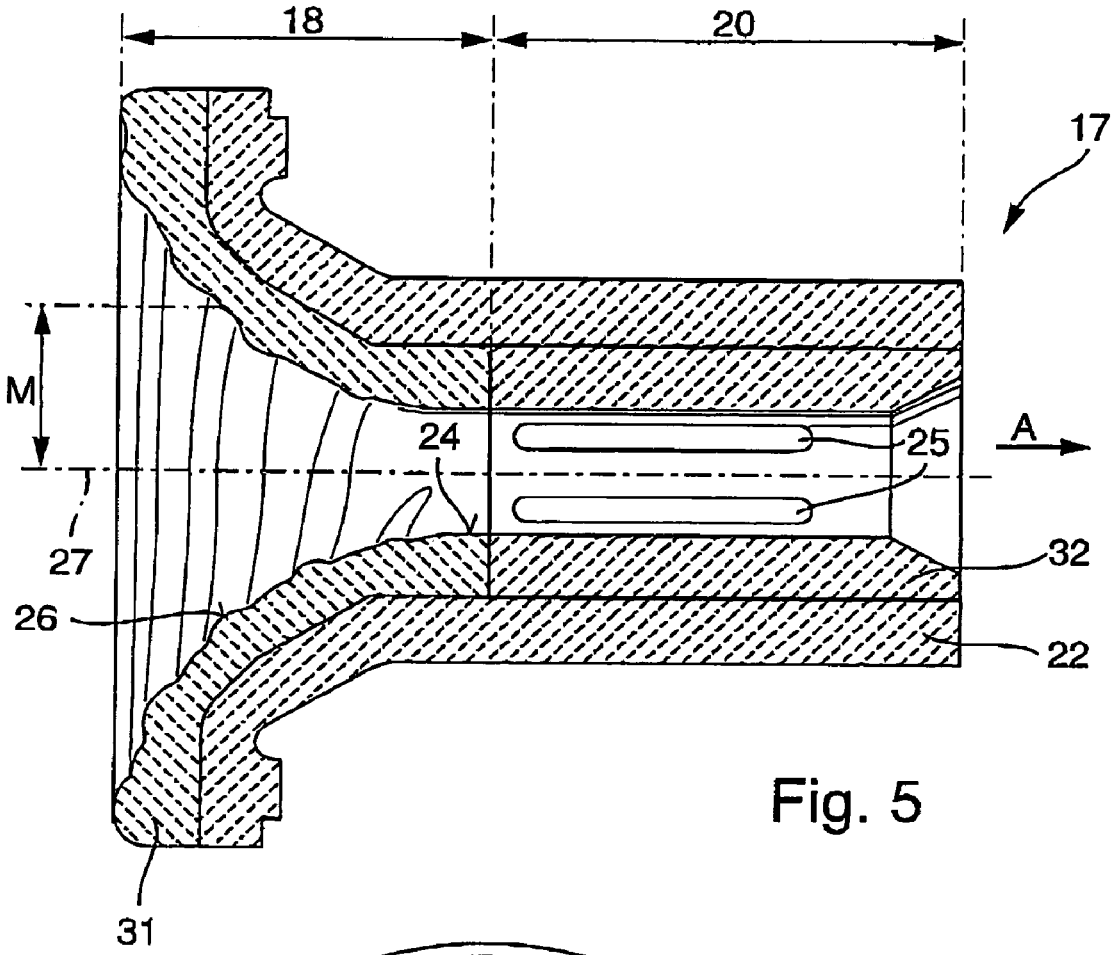
FIG. 5 is a view similar to FIG. 2, in which nozzle throat and yarn deflecting area are two-part components, constructed according to certain preferred embodiments of the present invention.

The embodiment according to FIG. 5 shows essentially the same as FIG. 2, the nozzle insert 21 in FIG. 5 however being designed as a two-part component. There is an insert 31 in the yarn deflecting area 18 and a second insert 32 in the nozzle throat 20. This has the advantage in that a plurality of inserts 32 having varying structures can be combined with one insert 31, which requires the more complicated manufacturing tool, in the nozzle throat 20, thus achieving a cost-effective high level of flexibility. Furthermore, it can be provided that the inserts 31 and 32 are made of different materials. For example, for the processing of temperature-sensitive polyester fibers, an insert 31 of steel can be made, preferably of hardened steel. In combination therewith, the insert 32 can be made of an aluminium oxide ceramic. Both inserts are adhered in the nozzle mounting 22. It can be alternatively provided that the surface 26 or the wall 24 are covered with a wear-resistant diamond coating.

Figure 6:
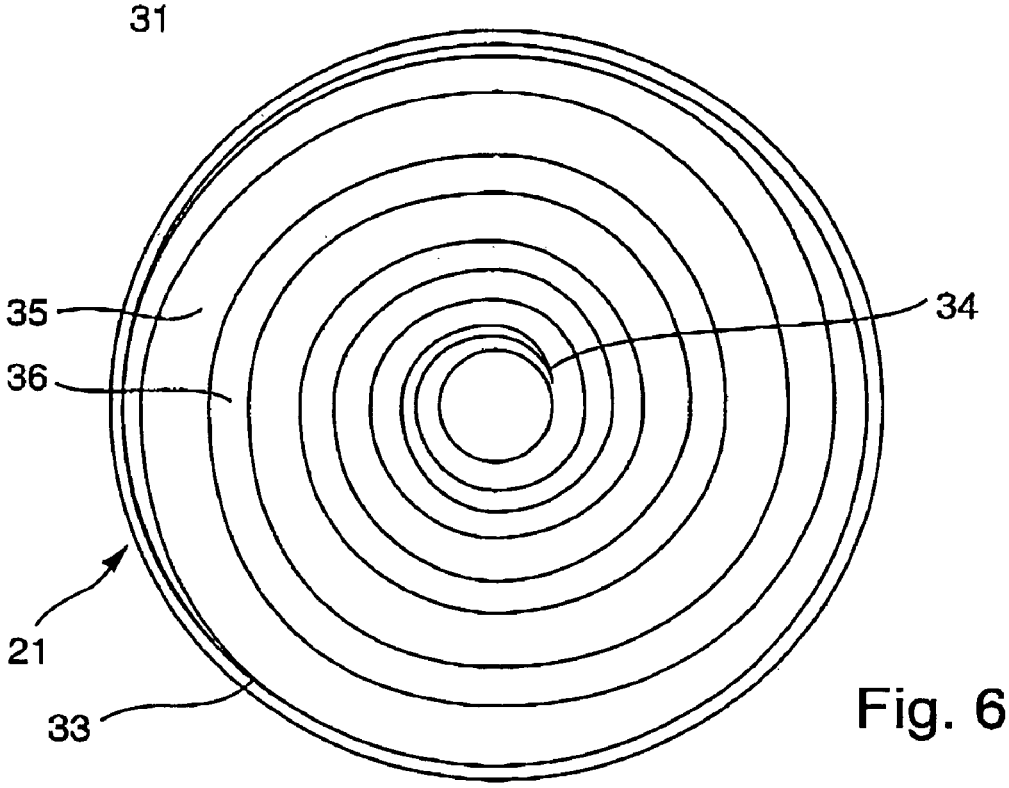
FIG. 6 is a frontal view in the yarn withdrawal direction of the yarn deflecting area with its spiral structure, constructed according to certain preferred embodiments of the invention.

It can be seen in FIG. 6 how the wavy-lined structure in the yarn deflecting area 18 winds spiral-like in radial direction. Also recognizable are the rounded run-outs of the structure at the beginning 33 and at the end 34. The bulges 35 and the recesses 36 of the wavy-lined structure are so formed that curved humps and recesses take up almost the same percentage area of the surface. It is almost impossible to establish whether the spirals form a raised area or a recess on a base surface. This has the advantage in that the yarn 14 is supported not only by the curved humps but also by the recesses at the 90° deflection. This achieves a non-aggressive transmission of the forces to the yarn without the fibers being damaged.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Yarn withdrawal nozzle for an open-end rotor spinning arrangement with improved spinning stability comprising a funnel-like decreasing yarn deflecting area ending in a substantially cylindrical entrance of a nozzle throat, in which a spiral shaped structure extends essentially over the entire yarn deflecting area, wherein the spiral shaped structure up to the nozzle throat is designed as a continuous surface without any interruptions, and wherein the nozzle throat in a yarn delivery direction downstream of the yarn deflection area is provided with a structure of a different shape, and wherein the structure of the yarn deflecting area and the structure of the nozzle throat consist of rounded bulges and/or rounded recesses, so that because of the structures, forces are transferred to the yarn without the yarn being damaged.

2. Yarn withdrawal nozzle according to claim 1, wherein the spiral-shaped structure in the yarn deflecting area has a surface which as seen in axial section is formed by a geometrical curve, whose distance from a middle line constantly and continuously decreases as the curve advances along the delivery direction.

3. Yarn withdrawal nozzle according to claim 1, wherein the structure in the nozzle throat comprises rounded bulges.

4. Yarn withdrawal nozzle according to claim 1, wherein the structure in the nozzle throat comprises gentle notches.

5. Yarn withdrawal nozzle according to claim 1, wherein the yarn withdrawal nozzle is made as a part of a mould, whereby a necessary mould separation is provided in an area downstream of the structure in the nozzle throat as seen in the delivery direction.

6. Yarn withdrawal nozzle according to claim 2, wherein the yarn withdrawal nozzle is made as a part of a mould, whereby a necessary mould separation is provided in an area downstream of the structure in the nozzle throat as seen in the delivery direction.

7. Yarn withdrawal nozzle according to claim 1, wherein the structures in the yarn deflecting area and in the nozzle throat are made from a high-performance ceramic.

8. Yarn withdrawal nozzle according to claim 2, wherein the structures in the yarn deflecting area and in the nozzle throat are made from a high-performance ceramic.

9. Yarn withdrawal nozzle according to claim 1, wherein the structures in the yarn deflecting area and in the nozzle throat are made of metal.

10. Yarn withdrawal nozzle according to claim 2, wherein the structures in the yarn deflecting area and in the nozzle throat are made of metal.

11. Yarn withdrawal nozzle according to claim 1, wherein the nozzle includes a nozzle insert which comprises two insert parts, whereby a first insert part comprises the yarn deflecting area and a second insert part comprises the nozzle throat.

12. Yarn withdrawal nozzle according to claim 11, wherein the first and second insert parts are made from different materials.

13. Yarn withdrawal nozzle according to claim 11, wherein the first insert part comprises a coating on its surface.

14. Yarn withdrawal nozzle according to claim 12, wherein the first insert part comprises a coating on its surface.

15. Yarn withdrawal nozzle according to claim 11, wherein the second insert part comprises a coating on its walls.

16. A method of making the yarn withdrawal nozzle of claim 1, comprising moulding the yarn withdrawal nozzle with a mould separation section disposed downstream of the nozzle throat as seen in the yarn delivery direction of the nozzle when in an in use position in an open-end rotor spinning arrangement.

17. A method of making the yarn withdrawal nozzle of claim 16, wherein the spiral-shaped structure in the yarn deflecting area has a surface which as seen in axial section is formed by a geometrical curve, whose distance from a middle line constantly and continuously decreases as the curve advances along the delivery direction.

18. A method of making the yarn withdrawal nozzle of claim 16, wherein the structures in the yarn deflecting area and in the nozzle throat are made from a high-performance ceramic.

19. A method of making the yarn withdrawal nozzle of claim 16, wherein the structures in the yarn deflecting area and in the nozzle throat are made of metal.

20. A method of making the yarn withdrawal nozzle of claim 16, wherein the structure in the nozzle throat comprises rounded bulges.

21. A method of making the yarn withdrawal nozzle of claim 16, wherein the structure in the nozzle throat comprises gentle notches.

* * * * *